US009714520B1

(12) United States Patent
Semaan

(10) Patent No.: US 9,714,520 B1
(45) Date of Patent: Jul. 25, 2017

(54) DIRECT ANCHORAGE TERMINATION FOR POLE REINFORCEMENT

(71) Applicant: Robert Semaan, Miami, FL (US)

(72) Inventor: Robert Semaan, Miami, FL (US)

(73) Assignee: TOWER ENGINEERING SOLUTIONS, LLC, Las Vegas, NV (US)

( * ) Notice: Subject to any disclaimer, the term of this patent is extended or adjusted under 35 U.S.C. 154(b) by 0 days.

(21) Appl. No.: 15/151,414

(22) Filed: May 10, 2016

(51) Int. Cl.
*E04H 12/22* (2006.01)
*E02D 27/42* (2006.01)
*E04G 23/02* (2006.01)
*E04H 12/08* (2006.01)

(52) U.S. Cl.
CPC ..... *E04H 12/2292* (2013.01); *E02D 27/42* (2013.01); *E04G 23/0218* (2013.01); *E04H 12/085* (2013.01)

(58) Field of Classification Search
CPC ... E04H 12/2292; E04H 12/085; E04H 12/20; E04H 12/22; E02D 27/42; E04C 5/12; E04G 23/0218
See application file for complete search history.

(56) References Cited

U.S. PATENT DOCUMENTS 1,995,874 A * 3/1935 Van De Mark ..... E04H 12/2292 238/29
4,032,244 A * 6/1977 Quayle ..... E02D 5/523 403/286
6,453,636 B1 * 9/2002 Ritz ..... E04H 12/2292 52/835
6,799,401 B1 * 10/2004 Legler ..... E04H 12/2276 52/169.13
7,849,659 B2 * 12/2010 Kopshever, Sr. .... H01Q 1/1242 52/18
8,156,712 B2 * 4/2012 Kopshever, Sr. .... H01Q 1/1242 52/848
8,191,332 B1 * 6/2012 Semaan ..... E02D 5/60 174/45 R
8,424,269 B2 * 4/2013 Kopshever ..... H01Q 1/1242 52/848
8,528,298 B2 * 9/2013 Semaan ..... E02D 5/60 174/45 R
8,959,857 B1 * 2/2015 Lin ..... E04H 12/2261 256/65.14
9,153,853 B2 * 10/2015 Lassiter ..... H01Q 1/1242
9,219,300 B1 * 12/2015 Lassiter ..... H01Q 1/1242
9,328,527 B2 * 5/2016 Lassiter ..... H01Q 1/1242
9,546,497 B2 * 1/2017 Semaan ..... E04H 12/08
2007/0256388 A1 * 11/2007 Ianello ..... E04H 12/2292 52/651.07
2012/0180427 A1 * 7/2012 Kopshever, Sr. .... H01Q 1/1242 52/834
2012/0233959 A1 * 9/2012 Semaan ..... E02D 5/60 52/719
2014/0053500 A1 * 2/2014 Lassiter ..... H01Q 1/1242 52/831

(Continued)

*Primary Examiner* — Andrew J Triggs
(74) *Attorney, Agent, or Firm* — Baker & Hostetler LLP

(57) ABSTRACT

An anchor bracket is secured to monopole reinforcing bars. The anchor bracket optionally includes a stiffener plate attached to the reinforcement plate. The stiffener plate is also attached to a hollow tube. An anchor passes through the tube of the anchor bracket and into the foundation of the monopole being reinforced.

6 Claims, 1 Drawing Sheet

(56) References Cited

U.S. PATENT DOCUMENTS

| | | | | |
|---|---|---|---|---|
| 2015/0075101 | A1* | 3/2015 | Semaan | C01B 6/24 52/514 |
| 2015/0252581 | A1* | 9/2015 | Perina | E02D 27/00 52/704 |
| 2015/0368922 | A1* | 12/2015 | Lassiter | H01Q 1/1242 52/514 |

* cited by examiner

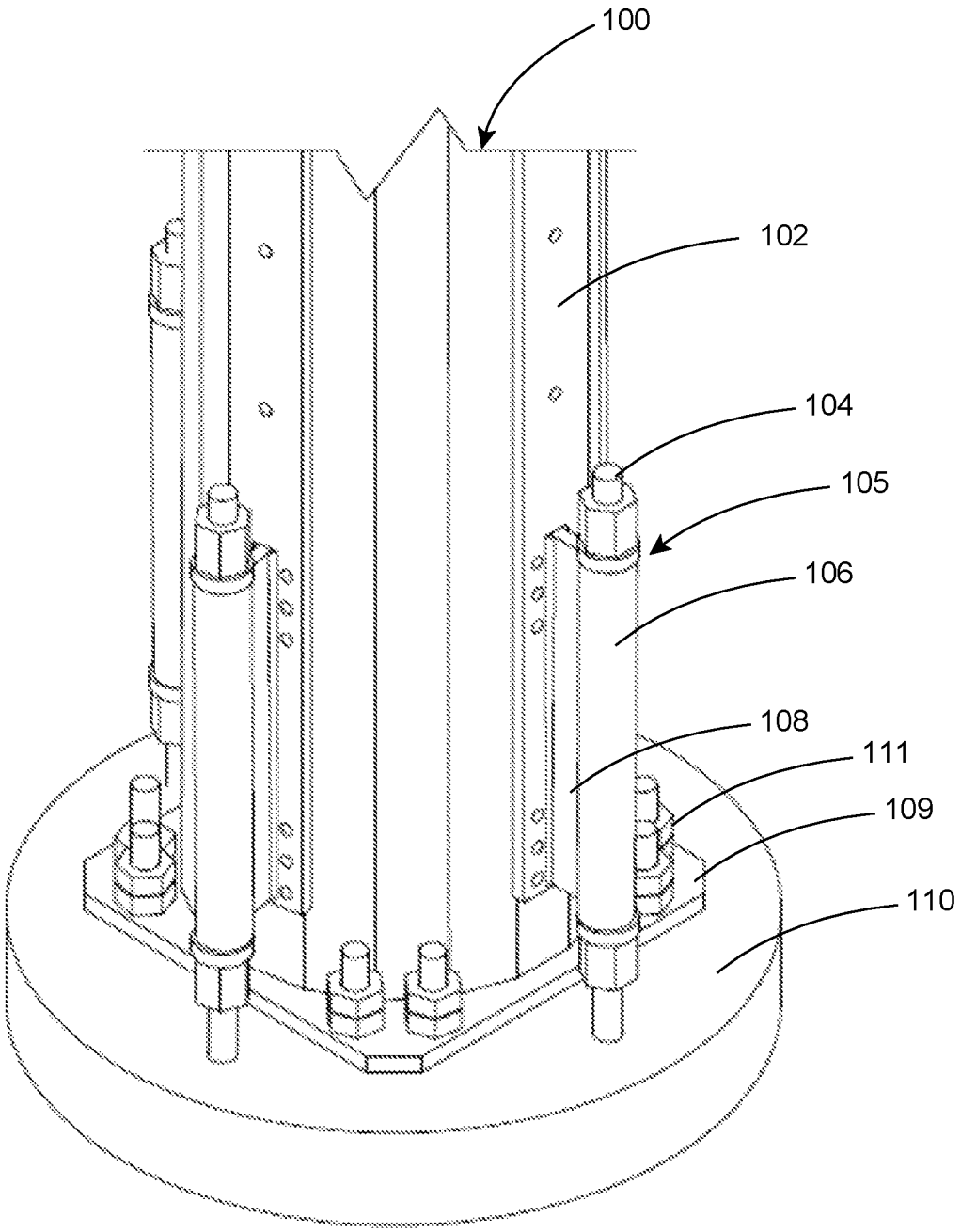
100
102
104
105
106
108
111
109
110

DIRECT ANCHORAGE TERMINATION FOR POLE REINFORCEMENT

FIELD OF THE INVENTION

The present invention relates to devices for anchoring poles, such as monopoles. More particularly, the present invention includes a bracket for securing a pole, such as a monopole, to an anchor, such as a foundation.

BACKGROUND OF THE INVENTION

Since the 1980's wireless networks for mobile communications have become more and more pervasive across the world. While the technical elements of the network (such as RF equipment, antennas and radios, and the like) have continued to evolve, the design of antenna supporting structures (or towers) has remained pretty much unchanged. The towers, whether self-supporting, guyed or of monopole type, have served the industry well through the ongoing evolution of network architecture, however, the modification of these existing tower structures to increase structural capacity is become more and more commonplace.

In order to support heavier and often more numerous antennas required by the current build out of LTE (Long Term Evolution) or 4G networks, the industry must find new and creative ways to add capacity to existing tower structures.

The more common tower type built in densely populated urban areas was the monopole. These monopoles are usually multi-sided tapered tubular structures with a very small profile and hence more attractive from a siting approval standpoint. These are also the more difficult to augment or modify structurally since the bolting of additional structural elements must be done from the outside as they are too narrow to access from the inside.

A common method of strengthening these monopoles has been the addition of steel elements to the pole shafts. This can be accomplished by adding flat plates or other structural steel shapes to the "flats or flat sides" of the multi-sided structures.

One aspect of these installations that has often been overlooked or misunderstood is the proper transfer of the forces from the additional steel elements to the foundation. In some instances of flat plate installation, the lower end is terminated simply by welding the flat plates directly to the base plate or in some cases directly on top of the original base plate weld, ignoring the effect to the base plate and the anchor bolts. Neither of these termination methods have been fully investigated possibly making these types of installations ineffective and unreliable.

Another method is to terminate by welding the flat plates to the pole shaft well above the base plate and to add vertical stiffener plates adjacent to new plates. This design, while more effective requires the proper spacing of both the flat plates and the vertical stiffeners and often results in total weld lengths of more than 20 ft. per location. This excessive field welding is not only costly, but is often difficult to complete to an adequate level of quality.

SUMMARY OF THE INVENTION

The present invention includes a device for anchoring and reinforcing a monopole. The monopole is supported by a foundation at the base of the monopole. The device includes a plurality of reinforcing bars attached to the monopole. In an optional embodiment, each reinforcing bar may include at least one load transfer connector attached thereto. In such an optional embodiment, a link plate, having openings shaped to mate with the load transfer connectors, may be used to splice adjoining reinforcing bars. More particularly, the link plate overlies adjoining reinforcing bars and the link plate openings mate with with the load transfer connectors of at least one of the adjoining reinforcing bars.

The device includes an anchor bracket attached to at least one of the reinforcing bars. In an optional embodiment, each anchor bracket includes a stiffener plate attached to the at least one reinforcing bar and a tube attached to the stiffener plate. An anchor is secured to the anchor bracket and secured to the foundation. In an optional embodiment, the anchor passes through the tube of the anchor bracket.

BRIEF DESCRIPTION OF THE DRAWINGS

FIG. 1 is an elevated perspective view of a pole and anchor bracket according to an embodiment of the present invention.

DESCRIPTION

Reference is now made to the figures wherein like parts are referred to by like numerals throughout. When the equipment requirement of new wireless networks exceeds the structural capacity of existing monopole structures, monopoles may be structurally modified by adding flat plates, flat bars, or other structural steel shapes to the monopole to reinforce the monopole. In one optional embodiment, the present invention includes a device to reinforce and anchor a monopole The present invention seeks to eliminate the excessive welding associated with terminating the reinforcement while also improving the reliability.

The present invention includes an anchor bracket 105 and anchor 104. The anchor bracket 105 is attached to a pole 100, optionally through reinforcing bars 102 as discussed below. In an optional embodiment, the anchor bracket 105 may be attached to the reinforcing bars 102, which are then bolted to the pole 100. In such an optional embodiment, the excessive welding widely used in current termination methods may be avoided. This is desirable in certain applications since existing poles 100 carry existing radio equipment, coaxial cables and other flammable equipment and reducing the use of welding reduces the risk of fire.

The anchor 104 secures the anchor bracket 105 to the foundation 110 of the pole 100. Thus, the anchor bracket 105 bracket provides a direct connection between the reinforcing bars 102, which have been secured to a monopole, and the existing concrete foundation 110 through the anchor 104.

In an optional embodiment, the device is used in cooperation with reinforcing bars 102 that are attached (for example, welded or otherwise fastened) to the monopole 100 to support and reinforce the pole 100. In one optional embodiment, the reinforcing bars 102 may include the connectors and link plates disclosed in our related U.S. patent application Ser. No. 14/552,263, which is incorporated herein by this reference. Briefly stated, in an optional embodiment, the reinforcing bars 102 include load transfer connectors, optionally at the ends of the reinforcing bars 102. Reinforcing bars 102 are spliced together using a link plate, which includes openings that mate with the load transfer connectors to overlie the joint between reinforcing bars being spliced. A cover plate may be fastened over the link plate.

Referring generally to FIG. 1, an optional embodiment of an anchor bracket 105 includes of one or more stiffener plates 108 attached to the main pole reinforcing bar 102. In an optional embodiment, the stiffener plates 108 are shop- or field-welded to the reinforcing bar 102, although it is contemplated that the stiffener plates may be connected to the reinforcing bars 102 in any manner. In the optional embodiment of FIG. 1, the anchor bracket 105 including the stiffener plate 108 and tube 106 are integral to the base section of the reinforcing bars 102 added to the pole 100. As illustrated in FIG. 1, the stiffener plates 108 run along the reinforcing bars 102 and extend perpendicularly from the reinforcing bars 102 near the base of the pole 100. However, it is contemplated that the stiffener plates 108 may attach to the reinforcing bars 102 in any angle or relationship. In an optional embodiment, the stiffener plate 108 extends away from the reinforcing bars so that the anchor 104 passing through the anchor bracket 105 will bypass the existing base plate 109 by either clearing it or by drilling a hole in the existing base plate 109 to allow for an anchor to pass through.

With continued reference to the optional embodiment of FIG. 1, each stiffener plate 108 may be connected to a tube 106. In an optional embodiment, the stiffener plate is shop- or field-welded to the tube 106. It is contemplated that the tube 106 may be round, square, or any other hollow-shaped tube.

In the optional embodiment illustrated in FIG. 1, an anchor 104 passes through the tube 106 and is secured to the foundation 110 supporting the pole 100. The anchor may take any form, including conventional concrete anchors such as Williams Anchors, Dywidag threaded bards, or the like. The anchor is drilled into the foundation 110 (e.g., the existing concrete foundation supporting the existing pole 100 being reinforced). Thus anchored, external forces on the monopole 100 are transferred, via the main pole reinforcing bars 102, to the concrete foundation 110.

It is contemplated that the reinforcing bars 102 may extend along the pole 100 to thereby support the pole 100. In an alternate optional use, however, the reinforcing bars 102 may only extend along the lower end of the pole 100. In such an optional embodiment, the anchor bracket 105 is used to add anchors 104 as a modification when existing anchors 111 are found inadequate. The anchor bracket 105 of such an optional embodiment can also be used to add anchors 104 thereby relieving overstress on existing base plates 109 by reducing the load being carried by them.

While certain embodiments of the present invention have been shown and described it is to be understood that the present invention is subject to many modifications and changes without departing from the spirit and scope of the claims presented herein.

I claim:

1. A device for reinforcing a pole supported by a foundation at a base of the pole, comprising:

at least one reinforcing bar comprising a first side proximate to and directly attached to the pole and a second side distal to and facing away from the pole;

at least one anchor bracket directly attached to the second side of the at least one reinforcing bar;

an anchor secured to the at least one anchor bracket and secured to the foundation; and a plurality of pole anchors that directly secure the pole to the foundation, wherein the pole anchors are separate from the anchor that secures the at least one anchor bracket to the foundation, and the pole anchors do not interact with the at least one anchor bracket.

2. The device of claim 1, wherein the at least one anchor bracket further comprises a stiffener plate attached to the at least one reinforcing bar and a tube attached to the stiffener plate such that the anchor is secured to the at least one anchor bracket through the tube.

3. The device of claim 1, wherein external forces applied to the pole bypass the base of the pole and are transferred from the at least one reinforcing bar directly through the at least one anchor bracket and the anchor to the foundation.

4. The device of claim 1, wherein the pole is a monopole.

5. The device of claim 1, wherein the anchor secured to the at least one anchor bracket is directly secured to the foundation and does not contact or pass through the base of the pole.

6. The device of claim 1, wherein the plurality of pole anchors directly secure the pole to the foundation through the base of the pole.

* * * * *